United States Patent [19]

Uchida

[11] 4,073,488

[45] Feb. 14, 1978

[54] DEVICE FOR DETECTING THE THICKNESS OF SHEETS

[75] Inventor: Isamu Uchida, Chigasaki, Japan

[73] Assignee: Laurel Bank Machine Co., Ltd., Tokyo, Japan

[21] Appl. No.: 635,764

[22] Filed: Nov. 26, 1975

[30] Foreign Application Priority Data

Nov. 29, 1974 Japan ..... 49-138073

[51] Int. Cl.[2] ..... B65H 7/12

[52] U.S. Cl. ..... 271/263; 271/106

[58] Field of Search ..... 271/11, 100–102, 271/106, 107, 258, 262, 263

[56] References Cited

U.S. PATENT DOCUMENTS

| | | | |
|---|---|---|---|
| 1,804,610 | 5/1931 | Halvorsen | 271/101 |
| 3,077,983 | 2/1963 | Middleditch | 271/263 X |
| 3,380,353 | 4/1968 | Mittermayer | 271/100 X |
| 3,731,916 | 5/1973 | Pettet | 271/263 |

*Primary Examiner*—Robert W. Saifer
*Attorney, Agent, or Firm*—Haseltine, Lake & Waters

[57] ABSTRACT

A device for detecting the thickness of sheets comprising a seizing roller on a first shaft mounted for counterclockwise rotation and a feed roller on a second shaft mounted for clockwise rotation and having a diameter smaller than that of the first shaft. The seizing roller includes a peripheral portion having a peripheral length slightly longer than each of bank notes to be transferred and cooperating with the feed roller and a recess for receiving the forward end of each bank note. The forward end of the bank note received in the recess is engaged between the feed roller and the peripheral portion of the seizing roller during their rotation to pass the bank note between the rollers. There is a displacement detecting device for detecting the displacement of the smaller roller shaft occurring during the passage of the bank note between the rollers.

3 Claims, 2 Drawing Figures

DEVICE FOR DETECTING THE THICKNESS OF SHEETS

Figure 1:
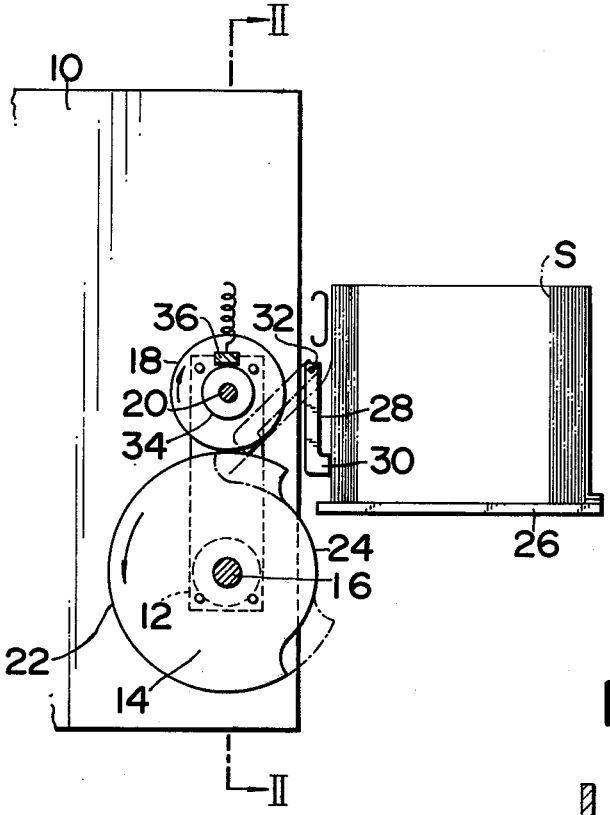

In paying machines for the payment of bank notes or other sheets it is necessary to count the number of notes which are fed out for the payment. In the counting, it sometimes happens that two or more notes are overlapped when they are fed or two or more notes are partly overlapped as they are continuously fed. In such cases, it is likely that two or more notes or sheets are counted as one sheet. Unless this event is detected, an extra number of notes other than the number instructed from a control section or the like are delivered. In order to avoid this, it has been the practice to provide overlap detection means and length detection means independent of one another, while separately providing a counter for counting the normally fed notes. Such arrangements, however, are subjected to the effects of temperature which adversely affect the accuracy. Also, since the individual detecting means have been provided separately, the over-all construction has had the trend of being complicated and providing insufficient results.

A main object of the present invention is to provide a device for effecting overlap detection, length detection, and the counting of bank notes at the same time.

According to the invention, this object is accomplished by providing a device comprising a seizing roller on a first shaft mounted for counterclockwise rotation, a feed roller on a second shaft mounted for clockwise rotation and having a diameter smaller than that of the first shaft, said seizing roller including a peripheral portion having a peripheral length slightly longer than each of the bank notes to be transferred and cooperating with the feed roller and a recess for receiving the forward end of each said bank note until it has been engaged between the peripheral portion of the seizing roller and the feed roller to pass the bank note between said rollers, and a displacement detecting means for detecting the displacement of the smaller roller shaft occurring during the passage of the bank note between the rollers.

An embodiment of this invention will now be described in detail with reference to the drawing.

Figure 2:
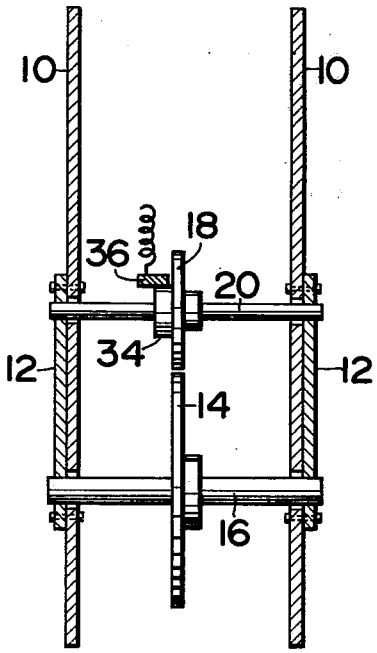

FIG. 1 is a schematic representation of a main portion of the mechanism of the thickness detection apparatus, and FIG. 2 is a cross sectional view taken along line II—II in FIG. 1.

Referring to FIGS. 1 and 2, there is illustrated a device according to the invention and comprising a pair of spaced side frames 10 on which side plates 12 are fixed. A seizing roller 14 is fixedly mounted on a horizontally extending shaft 16 rotatably supported on the side plates 12. A feed roller 18 is disposed above the seizing roller 14 and is fixedly mounted on a shaft 20 extending parallel to the shaft 16. The shaft 20 is rotatably supported on the side plates 12 and adapted to be driven clockwise. The shaft 16 is adapted to be driven counterclockwise at the same speed as that of the shaft 20. The shaft 20 has a diameter smaller than that of the shaft 16. The seizing roller 14 has a peripheral portion 22 cooperating with the feed roller 18 to define a gap between them, which is much smaller than the thickness of each of bank notes S and the roller 14 has a recess 24 for receiving the forward end of each of the bank notes. The peripheral portion 22 has its peripheral length slightly longer than the length of the bank notes.

A stacker 26 is arranged to hold the bank notes therein. A suction device 28 having a suction head 30 is disposed between the rollers 14 and 18 and the stacker 26 and is adapted to rotatably swing around a pivot 32 between a position at which the suction head 30 engages the bank notes in the stacker 26 and a position at which the forward end of the bank note which is transferred from the stacker 26 to rollers 14 and 18 by the suction head 30, is received in the recess 24 in the seizing roller 14.

The roller shaft 20 is provided with a measuring means 34 including a bearing (not shown) for rotatably receiving the roller shaft 20. There is a displacement detecting device 36 adapted to cooperate with the measuring means 34 and produce an electric signal corresponding to the displacement of the roller shaft.

In operation, when the seizing roller 14 is in the position as shown in chain dotted lines in FIG. 1, the suction device 28 is swung around the pivot 32 to convey one of the bank notes in the stacker 26 toward the rollers 14 and 18 so that the forward end of the bank note is received in the recess 24 in the roller 14. When the peripheral portion 22 has been rotated to cooperate with the feed roller 18, the forward end of the bank note is engaged between the rollers 14 and 18 so that due to the rotation of the rollers the bank note is fed through the gap between the rollers 14 and 18 in the leftward direction of FIG. 1. During the movement of the note, the gap between the rollers 14 and 18 is increased by the note so that the roller shaft 20 will be pushed upwardly together with the roller 18 relative to the shaft 16. Thus, the displacement detecting device 36 which is in contact with the measuring means detects the displacement of the roller shaft 20 to produce an electrical signal corresponding thereto. In other words, with the passage of a bank note between the rollers, the displacement detecting device produces an electric signal in accordance with the thickness of the note. Thus, by measuring the signal the thickness of the note can be detected. In the event of passage of two or more bank notes overlapping upon one another, the resultant signal produced has a magnitude no less than double that in the case of passage of a single note so that the overlap can be readily detected. Also, since the signal prevails during the passage of the note, through the measurement of the duration of the signal it is possible to detect whether it represents the regular feeding of a note or continuous feeding of two or more notes partly overlapping one another, that is, it is possible to effect the length detection.

The device according to the invention is constructed to minimize the effects of temperature upon the detection of the thickness.

Heretofore, the side plates 12 supporting the roller shafts in the sheet transfer device have been made of aluminum or like material in order to reduce the weight of the device, while the rollers and roller shafts have been made of steel for the sake of improving the precision and reducing wear. Therefore, the roller gap for the detection of the thickness has been prone to fluctuations with temperature due to the difference in the thermal coefficient of expansion between the two different metals constituting the device, and the adjustment with respect to temperature changes has been extremely difficult. In order to overcome this drawback, in the instant device, the thickness detection roller arrangement including the rollers and roller shafts is made independent of the rest of the construction such as the side frames. More particularly, the side plates 12 on which the roller shafts 16 and 20 are mounted are made of the same material as the rollers 14 and 18 and are installed on the respective side frames 10 of the apparatus. With this arrangement, with a temperature change, the diametrical length of the roller portions between the roller shafts changes substantially by the same amount as the change of length of the portion of each side plates between the roller shafts, that is, the effect of the temperature change upon the roller gap is substantially cancelled. Since the fluctuations of the roller gap are thus made negligibly small, it is possible to obtain accurate detection of the thickness of the note irrespective of temperature changes.

As has been shown in the foregoing, the apparatus according to the invention permits accurate detection of the thickness and length of bank notes or the like passing through it and, in addition, effect overlap detection, length detection and counting free from the effects of temperature. Thus, its practical value is very high for it provides improved performance and simplifies the detecting and counting means.

While in the embodiment of FIG. 2 only a single seizing roller and a single feed roller are shown for the sake of simplifying the description, it should be understood that a plurality of roller pairs are usually provided. The detecting device is usually provided singly substantially at a central part of the feed roller shaft, but it is possible to position it at another location if necessary.

I claim:

1. A device for detecting the thickness of bank notes or other sheets comprising a seizing roller, a first shaft mounted for counterclockwise rotation and supporting said seizing roller, a feed roller, a second shaft mounted for clockwise rotation and supporting said feed roller, said seizing roller including a peripheral length slightly longer than each of the bank notes to be transferred and a recess for receiving the forward end of each bank note until it has been engaged between the peripheral portion of the seizing roller and the feed roller to pass the bank note between said rollers, said second shaft supporting the feed roller having a diameter smaller than that of said first shaft to permit upward displacement thereof relative to the first shaft in the event of the passage of at least one bank note and a displacement detecting means for directly detecting the displacement of said second roller shaft to produce an electrical signal in accordance with the thickness of said at least one bank note.

2. A device as claimed in claim 1 wherein said displacement detecting means comprises means mounted on and rotatably receiving said first shaft, and a detecting device resiliently biassed against said means on said first shaft.

3. A device as claimed in claim 1 comprising side frames, and side plates mounted in said frames and supporting said rollers, said side plates, said shafts and said rollers being made of the same material.

* * * * *